United States Patent [19]

Harris et al.

[11] Patent Number: 4,605,092

[45] **Date of Patent: * Aug. 12, 1986**

[54] LARGE, HIGH R.P.M. DIESEL ENGINE EXHAUST MUFFLER

[76] Inventors: Theodore R. Harris, 14 El Patio, Orinda, Calif. 94563; Richard T. Harris, 3127 Stanley Blvd., Lafayette, Calif. 94549

[ * ] Notice: The portion of the term of this patent subsequent to Dec. 4, 2001 has been disclaimed.

[21] Appl. No.: 693,005

[22] Filed: Jan. 18, 1985

[51] Int. Cl.[4] ..... F01N 1/12

[52] U.S. Cl. ..... 181/280; 181/268; 181/272

[58] Field of Search ..... 181/272, 255, 268, 279–281, 181/275

[56] References Cited

U.S. PATENT DOCUMENTS 2,919,761 1/1960 Smith ..... 181/272
4,203,503 5/1980 Franco et al. ..... 181/272
4,317,502 3/1982 Harris et al. ..... 181/280
4,485,890 12/1984 Harris et al. ..... 181/280

*Primary Examiner*—Benjamin R. Fuller
*Attorney, Agent, or Firm*—James R. Cypher

[57] ABSTRACT

A muffler for large high r.p.m. internal combustion diesel engine in which the structure cancels sound waves by interference. The gases generally flow in one direction through the muffler with intermittant flow reversal occurring only upon acceleration. The muffler is formed with a plurality of longitudinal chambers divided by reflection walls. Edge echo openings in the reflection wall permit limited gas entry into the chambers. A plurality of helical members surrounded by a large open tube and pierced by a small open tube channel a substantial portion of all of the gases through a bulkhead wall which divides the muffler housing into two large open chambers and a smaller percentage of gases flows through one or more large open tubes.

10 Claims, 13 Drawing Figures

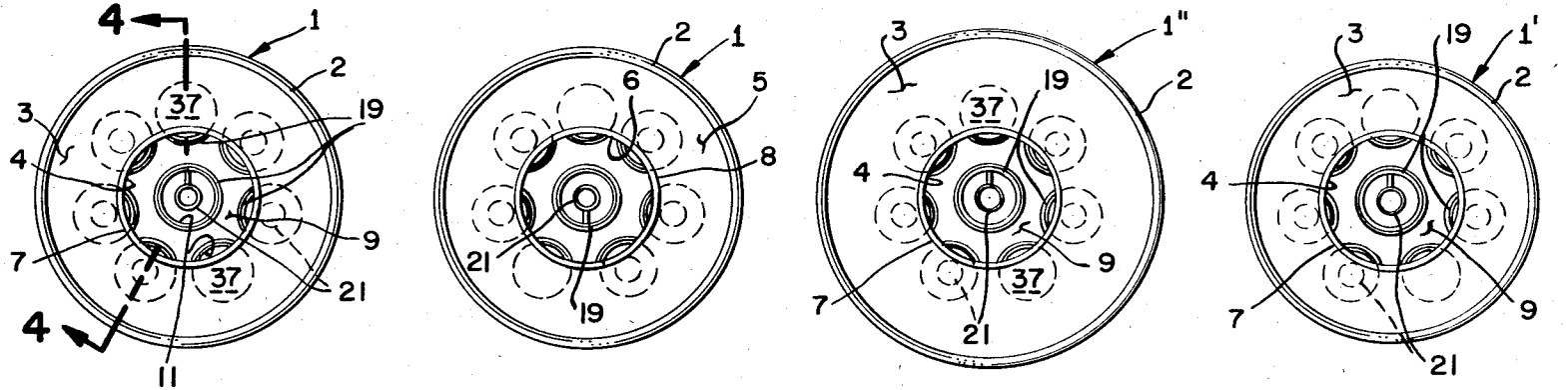
FIG. 2B
FIG. 2A
FIG. 3
FIG. 2
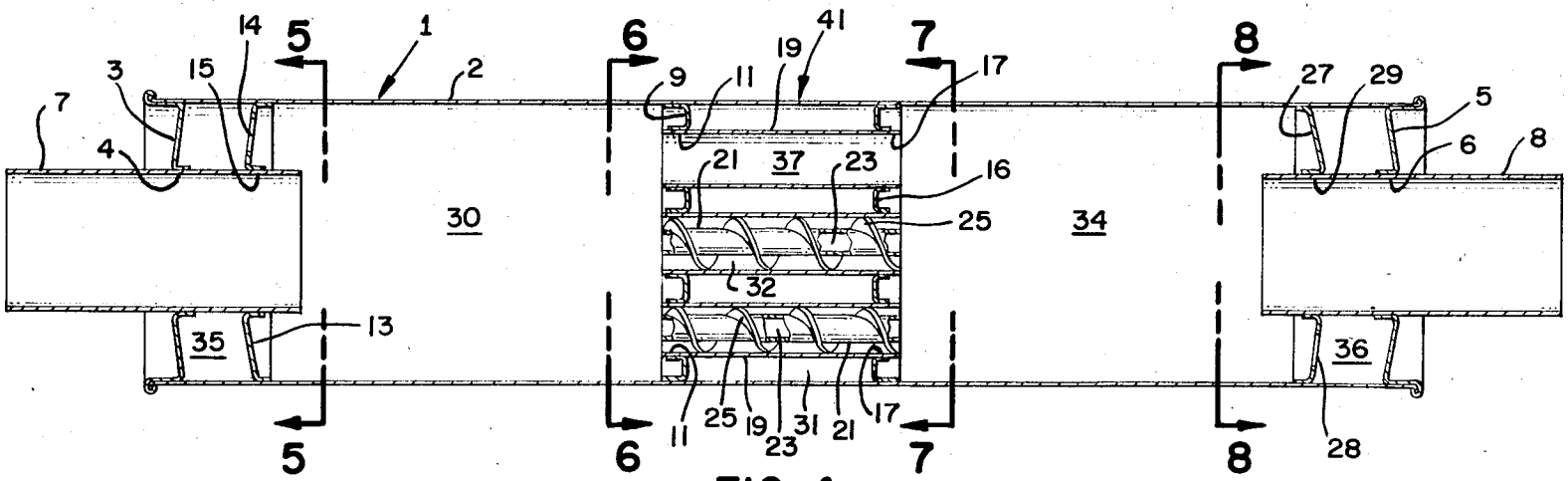
FIG. 4

LARGE, HIGH R.P.M. DIESEL ENGINE EXHAUST MUFFLER

BACKGROUND OF THE INVENTION

This invention relates to mufflers for large displacement high r.p.m internal combustion diesel engines mounted in large highway trucks and large stationary engines such as engines of 300 horse power and which turn at up to 2200 r.p.m.

This muffler resulted from a need for a muffler which would reduce the back pressure, increase gas velocity through the muffler, and thereby give better performance and increase mileage while at the same time reducing the sound level.

Our engine exhaust disclosed in U.S. Pat. No. 4,317,502 granted Mar. 2, 1982 and U.S. Pat. No. 4,485,890 granted Dec. 4, 1984 did not meet the requirements for large diesel trucks for noise levels, and our muffler for LARGE DIESEL ENGINE EXHAUST MUFFLER disclosed in U.S. application Ser. No. 668,660, filed Nov. 6, 1984 resulted in back pressures which were unacceptably high.

SUMMARY OF THE INVENTION

The muffler of the present invention for large high r.p.m. diesel trucks and other heavy equipment has a housing case which is substantially longer than automobile and light truck mufflers. Further, the length to diameter ratio is substantially greater than length to diameter ratio of automobiles and light trucks.

The muffler of the present invention has the same "tube within a tube" and a helix member interposed between the two tubes as my co-pending application for LARGE DIESEL ENGINE EXHAUST MUFFLER, Ser. No. 668,660, but with the very important difference that in the tube cluster one or more of the small tubes and its attached helix member are deleted. Equally important is the fact that in smaller displacement engines, the tube cluster may be mounted in the housing closer to the inlet end while the cluster may be moved closer to the outlet end for large displacement engines.

The combination of chambers on either side of the tube cluster with one or more open tubes unexpectedly results in a decibel level which is within government specifications and also results in a more acceptable and deeper tone level which truckers find more acceptable than state of the art mufflers.

Another objective is to reduce the back pressure and increase the velocity in the exhaust, especially in turbo equipped high r.p.m. diesel engines, thereby reducing the temperature in the exhaust which translates to an increase in available power. The cross sectional areas of the openings in the tubes in the tube cluster are equal to or slightly exceed the diameter of the inlet exhaust pipe.

BRIEF DESCRIPTION OF THE DRAWINGS

FIG. 2 is a front end view of the muffler shown in FIG. 1 taken along lines 2—2.

FIG. 2A is a front end view of a first alternate form of muffler taken along the same line 2—2 of FIG. 1. The alternate form is identical to the muffler shown in FIG. 1 except the casing diameter is larger.

FIG. 2B is a front end view of a second alternate form of muffler taken along the same line 2—2 of FIG. 1.

Figure 1:
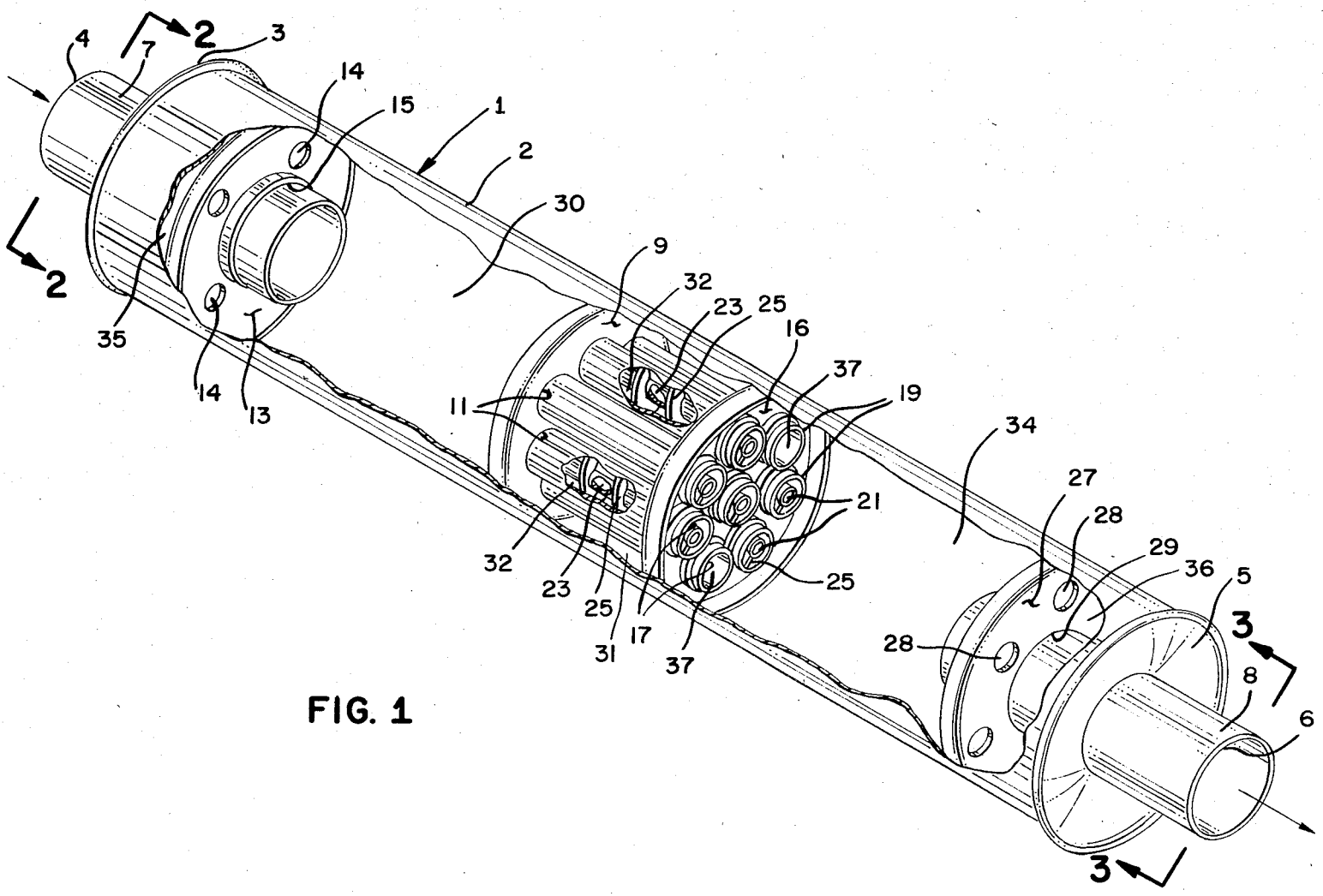
FIG. 1 is a perspective view of one form of the muffler of the present invention with portions cut away for purposes of illustration.

This alternate form is identical to the muffler shown in FIG. 1 except the casing diameter is smaller.

FIG. 3 is an end view of the discharge end of the muffler shown in FIG. 1 and taken along line 3—3.

FIG. 4 is a cross sectional view of the muffler taken generally along line 4—4 of FIG. 2 with selected portions cut away for purposes of clarity.

Figure 4A:
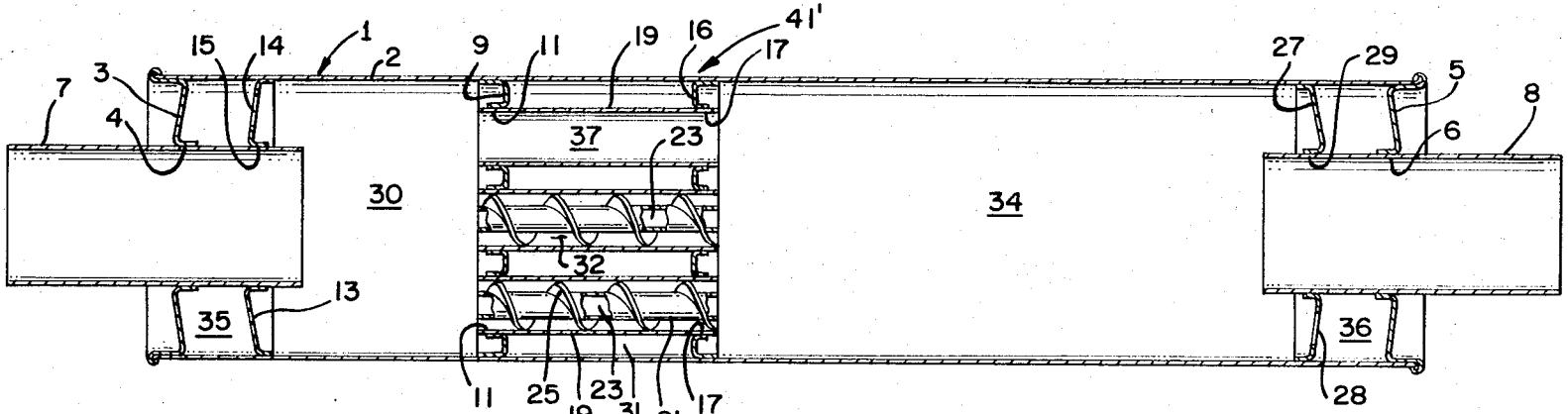

FIG. 4A is a cross sectional view of a third alternate form of the invention taken generally along line 4—4 of FIG. 2. Note that the tube cluster has been shifted toward the inlet end of the muffler.

Figure 4B:
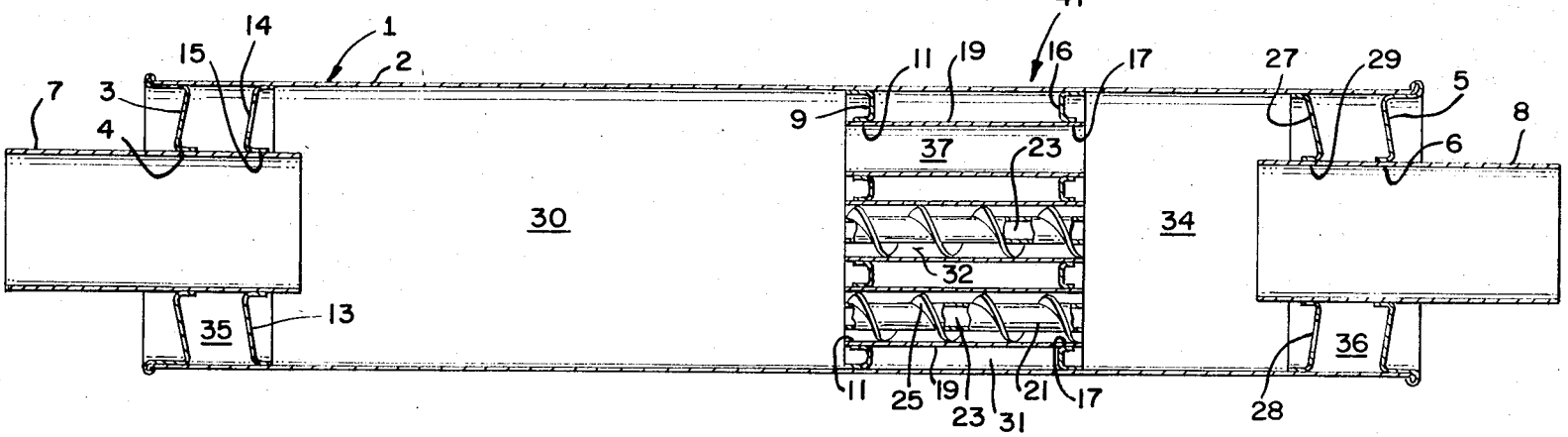

FIG. 4B is a cross sectional view of a fourth alternate form of the invention taken generally along line 4—4 of FIG. 2. Note that the tube cluster has been shifted toward the outlet end of the muffler.

Figure 5:
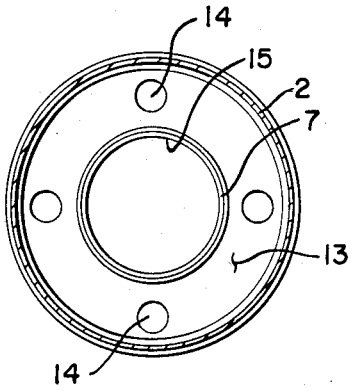

FIG. 5 is a cross sectional view of the muffler taken along line 5—5 of 4.

Figure 6:
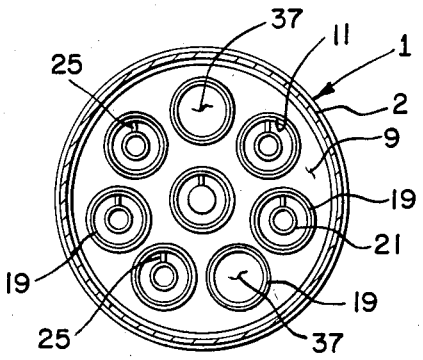

FIG. 6 is a cross sectional view of the muffler taken along line 6—6 of FIG. 4.

Figure 6A:
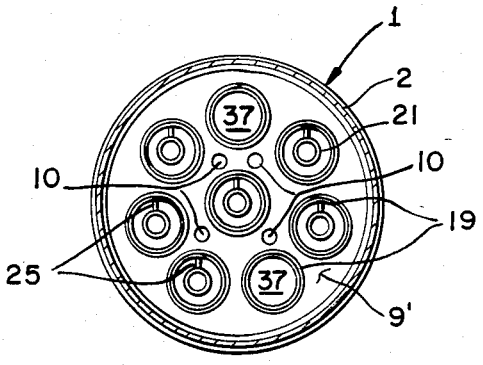

FIG. 6A is a cross sectional view of a modified form of the invention taken at the same location as line 6—6 in FIG. 4.

Figure 7:
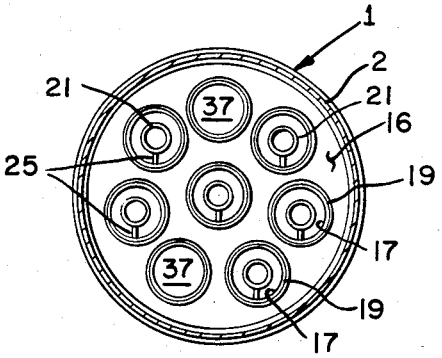

FIG. 7 is a cross sectional view of the muffler taken along line 7—7 of FIG. 4.

Figure 8:
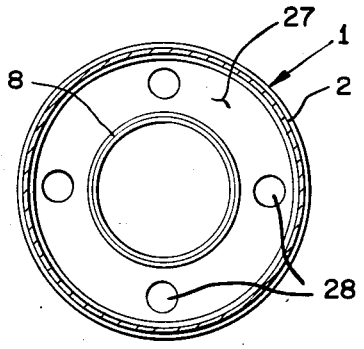

FIG. 8 is a cross sectional view of the muffler taken along line 8—8 of FIG. 4.

DESCRIPTION OF THE INVENTION

The muffler of the present invention is constructed so that the exhaust gases from a high r.p.m. internal combustion diesel engine travel from the upstream side of the muffler to the downstream side in generally the same direction as contrasted with standard mufflers in which a series of baffles cause the exhaust gases to follow a tortuous route, changing direction several times and even traveling in the opposite direction. The muffler thus enhances engine performance and quiets the engine without any sound absorbent materials which cause moisture to condense within the muffler and result in damaging rusting.

The present muffler reduces the sound level within required limits while creating a sound which is not objectionable.

The type of sound of the present muffler may be described as having a lower tone than standard truck mufflers which is probably caused by the reflecting walls and the mixing of the swirling gases imparted by the helixes and the direct pulsing gases emitting from the inner small tubes and from the large tubes which have no small tubes or helixes. The deeper tones also result from the oversize chambers on either side of the tube cluster. The sound is found to be pleasant because there is a multiplication of different frequencies resulting in a harmonic blending with the fundamental tones passing through the inner small tubes and large open tubes without helixes. The multiple frequencies are believed to result from passage of the pulsating exhaust through the helical swirl chambers and passage of exhaust through the multiple echo hole openings in the internal walls.

The internal combustion diesel engine muffler of the present invention consists of an elongated housing 1 having a curvilinear side wall 2, an inlet end wall 3 formed with a first inlet opening 4, and an outlet end wall 5 formed with a first outlet opening 6; and inlet tube 7 connected to the inlet end wall and communicating with the first inlet opening in the inlet end wall; and outlet tube 8 connected to the outlet end wall and communicating with the first outlet housing in the outlet end wall; a first internal reflection wall 9 axially spaced downstream from the inlet end wall forming a close fit with the curvilinear side wall and formed with large tube openings 11; a second internal reflection wall 13 spaced between the inlet end wall and the first internal reflection wall forming a close fit with the curvilinear side wall and formed with first edge echo openings 14 therethrough and a second inlet tube opening 15; the inlet tube communicates with the second inlet tube opening in the second internal reflection wall and is supported by the second internal reflection wall; a bulkhead wall 16 as shown in FIGS. 4 and 7 axially spaced downstream from the first internal reflection wall forms a close fit with the curvilinear side wall and is formed with large tube openings 17 axially aligned with the large tube openings in the first internal reflection wall; a plurality of elongated large tube members 19 connected to and extending from the first internal reflection wall to the bulkhead wall and communicating with the large tube openings in the first internal reflection wall and the bulkhead wall and connected to the bulkhead wall; inner small tube members 21 coaxially mounted within less than all of the large tubes forming small open ended pulse chambers 23; elongated helical members 25 in each of said large tubes having an inner small tube joining the small tubes and in the internal large tube members; a third internal reflection wall 27 as shown in FIGS. 4 and 8 is axially spaced downstream from the bulkhead wall forming a close fit with the curvilinear side wall and formed with second edge echo openings 28 therethrough and a second outlet tube opening 29 formed in alignment with the outlet opening in the outlet end wall the outlet tube is in communication with the second outlet tube opening in the third internal reflection wall, and is supported by the third internal reflection wall; a primary expansion chamber 30 is formed by the curvilinear side wall, the second internal reflection wall and the first internal reflection wall; helical elongated swirl and pulse smoothing chambers 32 are formed between the small tubes and the large tubes and defined by the helical members; and a primary interference chamber 34 is formed by the curvilinear side wall, the bulkhead wall and the third internal reflection wall; a first acceleration expansion chamber 35 formed by the curvilinear side wall, the inlet end wall, and the second internal reflection wall; and a second acceleration expansion chamber 36 is formed by the curvilinear side wall, the third internal reflection wall and the outlet end wall. The length of primary expansion chamber 30 in one form of the invention is substantially greater than the distance between first reflection wall 9 and bulkhead wall 16. Further, the length of primary interference chamber 34 is substantially greater than the distance between first reflection wall 9 and bulkhead wall 16 in the form of the invention illustrated in FIG. 1. Those large tubes 19 which do not have small tubes and helixes form large pulse chambers 37.

The inlet tube length extends a distance upstream beyond the third reflection wall. It has been found that as this distance becomes shorter, the noise level increases.

The location of the cluster of helix tubes plays a major role in the satisfactory performance of the muffler. The exact location is not critical, but an optimum working muffler for many engines appears to result when the cluster is located at approximately the midportion of the housing.

The alignment of the inlet tube, small inner tubes and outlet tube may vary. It has been discovered, however, that satisfactory operation may be achieved even when one of the aforesaid tubes are in substantial alignment with the inlet and outlet tubes. This fact can be readily observed by actually looking through either end of the muffler and seeing completely through the muffler.

Construction of the side walls of the muffler are 16 gauge double-wrapped; inner galvanized to inhibit acid and water corrosion with an outer wrap of aluminum clad steel to inhibit road salt corrosion.

The end walls are 16 gauge coated steel.

Pressed and rolled seams, not crimped, should be provided for durability and to withstand the pressure of backfires.

It has been found that the muffler heats up uniformly within a few minutes of operation so there are no hot or cold spots where moisture collects or vaporizes. The helix members are 16 gauge coated steel.

The housing typically is 44" long and 9" in diameter. Inlet and outlet tubes are 5" in diameter and a length of 12" with 4" of the tube extending beyond the end walls of the housing.

The inlet and outlet tubes are welded to one end wall or internal wall only. Thus expansion and contraction of the exhaust system longitudinally will not break the welds.

The large tube members also are welded to one internal wall. The tubes are preferably 7" in length with an outside diameter of 2". The tubes are preferably 16 gauge. The helical auger may be formed with a 2" pitch and both ends are welded to both the inner small tube members and the large tube members. The auger is sized to fit snugly between the two tubes.

The inner small tube members are 7" long and have an outside diameter of 13/16".

The three internal reflection walls and the bulkhead wall are preferably formed with perimeter flanges and are spot welded to the inner wall of the housing.

A modified form of the muffler is illustrated in FIG. 6A. The first reflector wall here shown as wall 9' is identical to wall 9 shown in FIG. 4 except that a plurality of third echo openings 10 are formed therethrough. Placing openings in the wall opens up a third acceleration expansion chamber 31 which is indicated on FIG. 4.

TURBO

The present muffler with its reduced back pressure has been found ideal for turbo equipped engines. The lower back pressure increases the pressure difference across the turbine, therefore increasing the efficiency of the turbine.

Operation of the muffler resulting in better acceleration is as follows: When an engine is accelerating in speed, higher pressures and a greater volume of exhaust gas is generated. The hot exhaust gases enter the muffler through inlet tube 7 and first pass in a series of rapid pulses into primary expansion chamber 30. The rapid buildup in pressure immediately causes an increase in pressure and flow through the small pulse chambers 23, large pulse chambers 37, and the swirl and pulse smoothing chambers 32. Without the possibility of dissipating the pressure, back pressure would increase and acceleration would be retarded as in a standard muffler and in the muffler set forth in U.S. Pat. No. 4,317,502 and all other mufflers known. The modified muffler is provided with a third acceleration expansion chamber 31 which permits a further pressure buildup in a relatively large chamber. Pressure buildup is also permitted in a first acceleration expansion chamber 35. Some pressure build-up also occurs in the primary interference chamber 34 and in the second acceleration expansion chamber 36.

The reduction of pressure in the large primary expansion chamber 30 results in a reduction of sound level. Instead of the hot gases suddenly striking a metal surface, the gases entering the large primary expansion chamber strike a volume of hot air before contacting the reflection wall 9. Further, because the pressure is quickly dissipated, the hot gases strike a volume of gases under lower pressure. In like manner, the gases discharging from chambers 23, 37 and 32, strike a large volume of gases which are cooling in chamber 34 before striking wall 27.

Noise level at start-up is greatest in most trucks. This results from hot gases from the engine striking cold air in the muffler. In standard mufflers, the noise level is not abated until the entire muffler is heated. In the present muffler, heating is in two stages so the muffler noise is abated within a shorter time and finally is further quieted as the entire muffler is heated. Two stage heating results from the construction of the muffler in two expansion chambers 30 and 34 separated by the cluster of tubes with helixes.

All of the hot gases from the engine are initially forced into the primary expansion chamber 30, and the first acceleration expansion chamber 35. The initial warm-up of the gases in the primary expansion chamber quickly reduces the temperatures differential between the entering engine gases and the temperatures of the gas in the upstream end of the muffler thereby quickly quieting the exhaust sound. As the engine continues to operate, the chambers on the downstream side of the bulkhead wall warm up and the temperature tends to equalize.

Sound level is largely a function of the ability of the muffler to convert rapid impulses of high pressure hot gases to a smooth non-pulsing flow of cooler gases to the cooler atmospheric air. This is accomplished in the following manner. All of the chambers set forth above permit expansion and cooling of the gases.

Gases flowing through the swirl and pulse smoothing chambers 32 cause a rapid dissipation of the pressure pulses.

Sound level is also decreased by a mixing of the pulsing gases by what is known as interferences of sound waves. This interference phenomenon occurs primarily in primary interference chamber 34. Gases discharging from the swirl and pulse smoothing chambers 32 are caused to swirl by the helix members. These swirling gases mix with more rapidly moving gases being discharged through small pulse chambers 23 and large pluse chambers 37.

Of course, pressure pulses are also removed by the reflection of the gases between the reflection walls of each of the chambers.

Some further noise reduction occurs at each of the edge echo openings by a phenomenon known as "echo" caused by the gases attempting to pass by the sharp edges of a narrow opening between two large chambers. The edges cause a compression of the gases resulting in a change in frequency of the pressure waves thereby resulting in interference and canceling of the sound waves.

Finally, all noises are more easily tolerated if the sound is a blend of harmonics. Just as an orchestra playing discordant sounds can sound very irritating and an orchestra with the various instruments playing in harmony can sound very good even though still playing loud; so too a muffler emitting harmonic sounds, sounds less irritating than one sounding one or more loud discordant sound frequencies.

In the present muffler, the various parts are "tuned" to produce harmonic sound frequencies. These different sounds are produced by various elements in the muffler. First, the hot gases discharging from inlet pipe 7 into primary expansion chamber 30 create a sound at a relatively low frequency. Gases passing third echo edge opening 10 create a high frequency sound. Gases entering at a lower velocity into third acceleration expansion chamber 31 create a low frequency sound. Gases passing echo edge opening 14 into small first acceleration expansion chamber 35 create a high frequency sound. The gases passing into the small chamber 35 strike the inlet end wall and create a medium frequency tone.

Gases passing through the swirl and impulse smoothing chambers 32 create a plurality of sounds at different frequencies as they pass through the helical members. At the same time, the inner small tubes create a fundamental tone.

The passing of the swirling gases and the direct impulse gases from the small tubes 21 mix in the primary interference chamber and break up into a multiplicity of sounds. Of course, the second echo edge opening 28 creates a high frequency sound and a low frequency sound is created in the second accelerating chamber 36. Gases passing directly through the large pulse chambers 37, create a lower fundamental tone than the fundamental tone caused by the small tubes 21.

Reverberation takes place in all of the chambers and even the length of outlet tube 3 extending into chamber 34 affects the noise level.

The following quotation is taken from *Mechanical Engineers' Handbook*, Lionel S. Marks, 5th Ed., McGraw Hill Book Co., Copyright 1951.

> "Exhaust back pressure should be kept to a minimum since an increase of 1 psi in back pressure decreases the maximum power output about 2½ percent, about 1 percent being due to more exhaust work and the balance to the effect of increased clearance gas pressure on volumetric efficiency."

In the present muffler, the combined cross sectional area of the inner small tube members 21, the large tubes without helixes, and the open area between the large tube members 19 and the small tube members 21 is greater than either of the individual cross sectional areas of inlet tube 4 and outlet tube 8. Because of this relationship, there is no restricting area within the muffler to cause further compression of the gases. This is contrary to standard mufflers which have constricting areas within the muffler.

The muffler illustrated in FIG. 1 is the preferred configuration for the largest of the truck diesel engines. Eight tubes are shown in the tube cluster with seven of the tubes evenly spaced around a central tube. Two of the large tubes do not have helixes or small tubes. For diesel engines of smaller displacement, fewer tubes should be used so that the cross sectional area of the openings through the tubes in the cluster will more nearly match the cross sectional area of the inlet exhaust pipe.

For ease in manufacturing different mufflers, the tubes and helix members may be identically dimensioned as the tubes and helix members previously described. To fine tune the cross sectional area of the gas openings through the tube cluster, the tube diameters may be increased or decreased accordingly. The geometric arrangement of the tubes has not been found to be critical.

Referring to FIG. 4A, an alternate form of the invention is illustrated. In this form, all elements of the muffler are identical to the form shown in FIG. 4 except that the cluster 41 of tubes and helix members is shifted toward the inlet end of the muffler and is identified as cluster 41'. The muffler is not redescribed and like parts have identical numbers as the muffler shown in FIG. 4. The muffler in FIG. 4 with the cluster 41 mounted at or near the midpoint of the muffler casing is suitable for class 7 and 8 trucks with displacements of about 900 cubic inches in 6 and 8 cyclinder engines. It was found in tests that the cluster could be moved from the center of the muffler where there was about 8 inches distance between the first reflection wall 9 and the downstream end of about 7 to a point, about 4 inches from the end of the tube 7. This configuration as shown in FIG. 4A creates a condition in which the primary expansion chamber 30 is substantially smaller than the primary interference chamber 34. Good results were obtained shifting the cluster toward the inlet end for engines having smaller displacements and in the 250 to 300 horsepower range.

Another alternate form of the invention is illustrated in FIG. 4B. In this form, all of the elements are identical to the muffler shown in FIG. 4 except that the cluster of tubes and helix members 41 has been moved toward the exhaust end of the muffler. This muffler configuration worked well for large displacement engines having 350 to 600 horsepower ratings. The cluster is shown in FIG. 4B as cluster 41''. The description of the muffler in FIG. 4B is not repeated and all elements which are identical to the elements in FIG. 4 have the same element number. It was found in tests that the muffler of FIG. 4B actually increased the horsepower of the engines tested by 4 or 5 horsepower and actually lowered the sound level emitted. Applicants have not been able to conduct enough tests as yet to account for the increase in horsepower or the reduction in sound level.

It has been found that a housing with a 9" diameter is suitable for most installations. Mufflers with housing diameters of 8" have been tested satisfactorily and a cross section of this muffler is illustrated in FIG. 2B. Since all parts of the muffler are identical except for the smaller housing, a description is not repeated. The housing as shown in FIG. 2B is designated 1'.

FIG. 2A illustrates another form of the muffler which is constructed with a 10" housing, and is designated by the number 1". Again, the muffler of FIG. 2A is identical in all other respects to the muffler described in FIG. 1. Like parts are designated with identical numbers and the description is not repeated.

The housing length may be from 30" to 44". School buses and class 6 trucks use mufflers having a housing length of 36".

We claim:

1. An internal combustion engine muffler comprising:

a. an elongated housing having a curvilinear side wall, an inlet end wall formed with a first inlet opening, and an outlet end wall formed with a first outlet opening;

b. an inlet tube connected to said inlet end wall and communicating with said first inlet opening in said inlet end wall;

c. an outlet tube communicating with said first outlet opening in said outlet end wall;

d. a first internal reflection wall axially spaced downstream from said inlet end wall forming a close fit with said curvilinear side wall and formed with a pluralty of large tube openings;

e. a second internal reflection wall spaced between said inlet end wall and said first internal reflection wall forming a close fit with said curvilinear side wall and formed with a first edge echo orifice opening therethrough and a second inlet tube opening;

f. said inlet tube communicates with said second inlet tube opening in said second internal reflection wall;

g. a bulkhead wall axially spaced downstream from said first internal reflection wall forming a close fit with said curvilinear side wall and formed with a plurality of large tube openings axially aligned with said large tube openings in said first internal reflection wall;

h. a plurality of elongated internal large tube members extending from said first internal reflection wall to said bulkhead wall and communicating with said large tube openings in said first internal reflection wall and said bulkhead;

i. inner small tube members coaxially mounted within less than all of said large tubes forming small open ended pulse chambers;

j. helical members in each of said large tubes having an inner small tube joining each of said inner small tubes and said large tube members;

k. a third internal reflection wall axially spaced downstream from said bulkhead wall forming a close fit with said curvilinear side wall and formed with a second edge echo orifice opening therethrough and a second outlet tube opening formed in alignment with said first outlet opening is said outlet end wall;

l. said outlet tube is in communication with said second outlet tube opening in said third internal reflection wall;

m. a primary expansion chamber formed by said curvilinear side wall, said second internal reflection wall and said first internal reflection wall;

n. elongated swirl and pulse smoothing chambers formed between said small tubes and said internal large tubes and divided by said helical members;

o. a primary interference chamber formed by said curvilinear side wall, said bulkhead wall and said third internal reflection wall;

p. a first acceleration gas expansion chamber formed by said curvilinear side wall, said inlet end wall, and said second internal reflection wall;

q. a second acceleration gas expansion chamber formed by said curvilinear side wall, said third internal reflection wall and said outlet end wall;

r. said plurality of internal large tube members mounted between said first reflection member and said bulkhead member are positioned at substantially the mid-point of said housing; and s. at least one large open ended pulse chamber formed within one of said large tubes which does not include an inner small tube and helical member.

2. A muffler as described in claim 1 comprising:
a. said internal large tubes, inner small tubes and said helical members are substantially co-extensive in length and their ends are substantially coterminus.
3. A muffler as described in claim 2 wherein:
a. said ends of said internal large tubes extend a minimal distance beyon said bulkhead member.
4. A muffler as described in claim 3 wherein:
a. said outlet tube extends a substantial distance upstream beyond said outlet end wall.
5. A muffler as described in claim 1 wherein:
a. said first internal reflection wall is formed with a plurality of third edge echo orifice openings therethough; and
b. a third acceleration gas expansion chamber formed by said curvilinear side wall, said first internal reflection wall and said bulkhead wall.
6. A muffler as described in claim 1 wherein:
a. there are at least eight elongated internal large tube members.
7. A muffler as described in claim 6 wherein:
a. at least seven of said large tubes include inner small tubes and a helical member.
8. A muffler as described in claim 6 wherein:
a. more than four and less than six of said large tube members include inner small tubes and a helical member.
9. A muffler as described in claim 1 wherein:
a. said plurality of large tube members mounted between said first reflection member and said bulkhead member are positioned so that said primary expansion chamber is substantially smaller than said primary interference chamber.
10. A muffler as described in claim 1 wherein:
a. said plurality of large tube members mounted between said first reflection member and said bulkhead member are positioned so that said primary expansion chamber is substantially larger than said primary interference chamber.

* * * * *

UNITED STATES PATENT AND TRADEMARK OFFICE

CERTIFICATE OF CORRECTION

PATENT NO. : 4,605,092

DATED : August 12, 1986

INVENTOR(S) : Theodore R. Harris and Richard T. Harris

It is certified that error appears in the above-identified patent and that said Letters Patent is hereby corrected as shown below:

Column 2, line 17, after "of" insert ---FIG.---

Column 5, line 34, change "temperatures" to --- temperature---

Column 6, line 27, after "tubes" insert ---21---

Column 8, line 42, change "is" to ---in---

Column 9, line 7, change "beyon" to ---beyond---

Signed and Sealed this

Twenty-eighth Day of October, 1986

[SEAL]

*Attest:*

DONALD J. QUIGG

*Attesting Officer* *Commissioner of Patents and Trademarks*